US006975269B2

(12) United States Patent
Jecko et al.

(10) Patent No.: US 6,975,269 B2
(45) Date of Patent: Dec. 13, 2005

(54) BROADBAND OR MULTIBAND ANTENNA

(75) Inventors: Bernard Jecko, Rilhac Rancon (FR); Cyril Cheype, Chamberet (FR); Cédric Serier, Bellac (FR); Marc Thevenot, Perilhac (FR); Thierry Monediere, Limoges (FR)

(73) Assignee: Centre National de la Recherche Scientifique (C.N.R.S.), Paris (FR)

( * ) Notice: Subject to any disclaimer, the term of this patent is extended or adjusted under 35 U.S.C. 154(b) by 0 days.

(21) Appl. No.: 10/488,493

(22) PCT Filed: Sep. 18, 2002

(86) PCT No.: PCT/FR02/03190

§ 371 (c)(1),
(2), (4) Date: Mar. 3, 2004

(87) PCT Pub. No.: WO03/028157

PCT Pub. Date: Apr. 3, 2003

(65) Prior Publication Data

US 2004/0189529 A1 Sep. 30, 2004

(30) Foreign Application Priority Data

Sep. 24, 2001 (FR) ..... 01 12279

(51) Int. Cl.[7] ..... H01Q 1/38
(52) U.S. Cl. ..... 343/700 MS; 343/846
(58) Field of Search ..... 343/700 MS, 846, 343/848, 829, 830

(56) References Cited

U.S. PATENT DOCUMENTS 4,827,271 A * 5/1989 Berneking et al. ... 343/700 MS
5,153,600 A * 10/1992 Metzler et al. ..... 343/700 MS
5,497,164 A * 3/1996 Croq ..... 343/700 MS
5,745,080 A * 4/1998 Jun ..... 343/700 MS
6,384,785 B1 * 5/2002 Kamogawa et al. . 343/700 MS

FOREIGN PATENT DOCUMENTS

DE 196 07 934 7/1997
FR 2 801 428 5/2001

OTHER PUBLICATIONS

Prosvirnin S L et al:, "Multi-Layered Arrays of Conducting Strips: Switchable Photonic Bandgap Structures" AEU International Journal of Electronics and Communications, Gustav Fisher Verlag, Jena, De, vol. 55, No. 4, 2001, pp. 260-265, XP001053905, ISSN: 1434-8411, p. 264, right-hand column, paragraph 3; figures 2-4.

Contopanagos H et al:, "Thin Frequency-Selective Lattices Integrated in Novel Compact MIC, MMIC, and PCA Architectures", IEEE Transactions on Microwave Theory and Techniques, IEEE Inc. New York, US, vol. 46, No. 11, Part 2, Nov. 1, 1998, pp. 1936-1947, XP000785383, ISSN: 0018-9480, p. 144, left-hand column, paragraphs 1, 2; figure 11.

* cited by examiner

*Primary Examiner*—Hoang V. Nguyen
(74) *Attorney, Agent, or Firm*—Young & Thompson

(57) ABSTRACT

A broadband or multiband antenna for microwaves, optical transmission or mobile telephones in which a reflector plane and at least one radiating element disposed in the vicinity of the reflector plane are provided. An assembly of defective PFB material elements is superposed on the reflector plane and the radiating element. Each defective PFB material element is substantially plane, parallel to the reflector, and presents at least one characteristic of magnetic permeability, of dielectric permittivity, and/or of thickness in the direction perpendicular to the reflector that differs from one defective PFB material element to another. The assembly forms a leaky resonant cavity.

26 Claims, 5 Drawing Sheets

BROADBAND OR MULTIBAND ANTENNA

The invention relates to a broadband or multiband antenna for microwaves, made using photonic forbidden band materials, referred to as PFB materials.

It has already been proposed to use PFB materials for implementing antennas for microwaves.

Figure 1A:
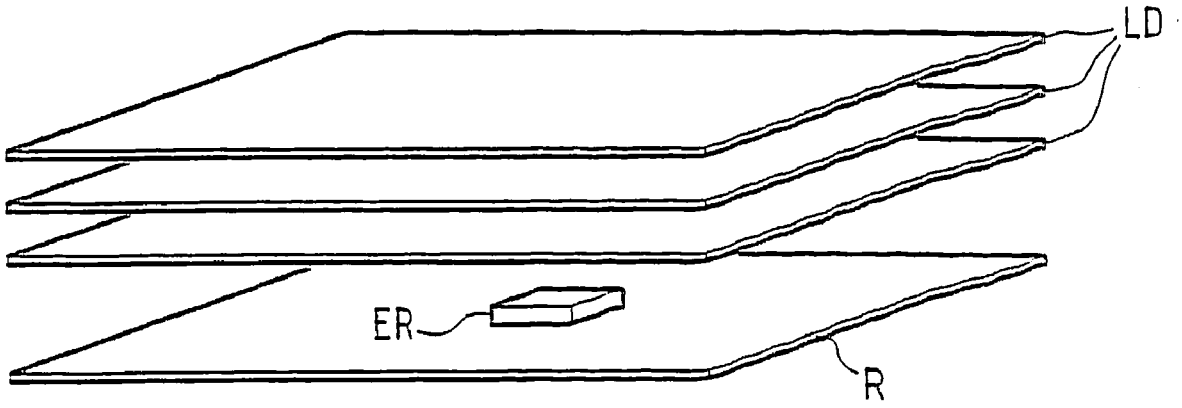
FIG.1a ( Prior Art )

With reference to FIG. 1*a*, which relates to the prior art, antennas of that type essentially comprise a reflector plane, a feed point or transmit/receive radiating element placed in the vicinity of the reflector plane, and an assembly of at least two dielectric materials superposed over the reflector plane and the transmit/receive feed point. The dielectric materials used differ in their permittivity or permeability, and the assembly formed in this way constitutes a PFB material.

Figure 1B:
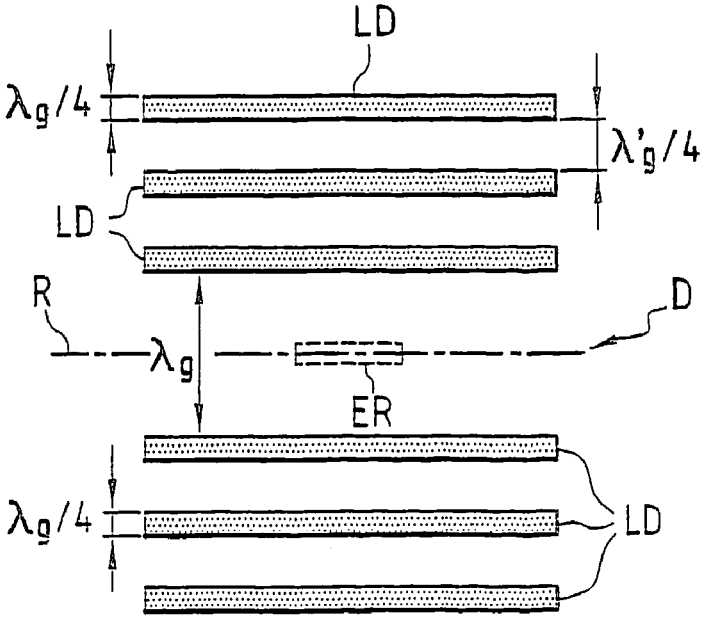
FIG.1b ( Prior Art )

With reference to FIG. 1*b*, it is recalled that a PFB material is a material which possesses the property of filtering (absorbing) certain frequency ranges, i.e. of preventing any transmission in the above-mentioned frequency ranges. Under such conditions, the material is referred to as a photonic forbidden band (PFB) material.

As shown in FIG. 1*b*, a PFB material is generally constituted by a periodic arrangement of dielectrics of varying permittivity and/or permeability.

By introducing a break in such geometrical and/or radio periodicity, where such a break is also referred to as a "defect", and can be obtained by omitting a "central" element, it is possible to generate an absorption defect, thereby creating a transmission band in the forbidden band of the PFB material. Under such conditions, the PFB material is referred to as a defective PFB material.

For a more detailed description of antennas of this type, reference can usefully be made to French patent application 99/14521, made available to the public on May 25, 2001 under the No. 2 801 428.

Such an antenna gives satisfaction.

Nevertheless, specifically because of its structure, the passband that can be achieved with such an antenna is relatively narrow and does not exceed 4% to 5% of the center frequency for attenuation of 6 dB.

An object of the present invention is to remedy the above-mentioned drawbacks and limitations of prior art defective PFB material antennas.

In particular, an object of the present invention is to implement a broadband antenna of the defective PFB material type presenting a passband that is significantly improved or subdivided into multiple passbands.

Another object of the invention is also to implement a broadband antenna of simple structure in the absence of any added dispersive or absorbent element by breaking the regularity or by making implementation more complex.

The broadband antenna of the present invention is remarkable in that it comprises at least one plane constituting a reflector and at least one transmit/receive feed point placed in the vicinity of said reflector-constituting plane. In addition, an assembly is provided of defective PFB material elements placed substantially in superposition with the reflector-constituting plane and the feed point. Each defective PFB material element forming the assembly is substantially plane and parallel to the plane constituting the reflector, and at least one of the characteristics of dielectric permittivity, magnetic permeability, and/or thickness in the direction perpendicular to the reflector-constituting plane of said elements is substantially different from one defective PFB material element to another, such that the unit formed by the reflector-constituting plane and the assembly of defective PFB material elements forms a leaky resonant cavity.

The broadband antenna of the present invention finds a particular application in making microwave antennas suitable for use in the field of mobile radiotelephones, and optical telecommunications in the visible or the invisible part of the spectrum.

Figure 2A:
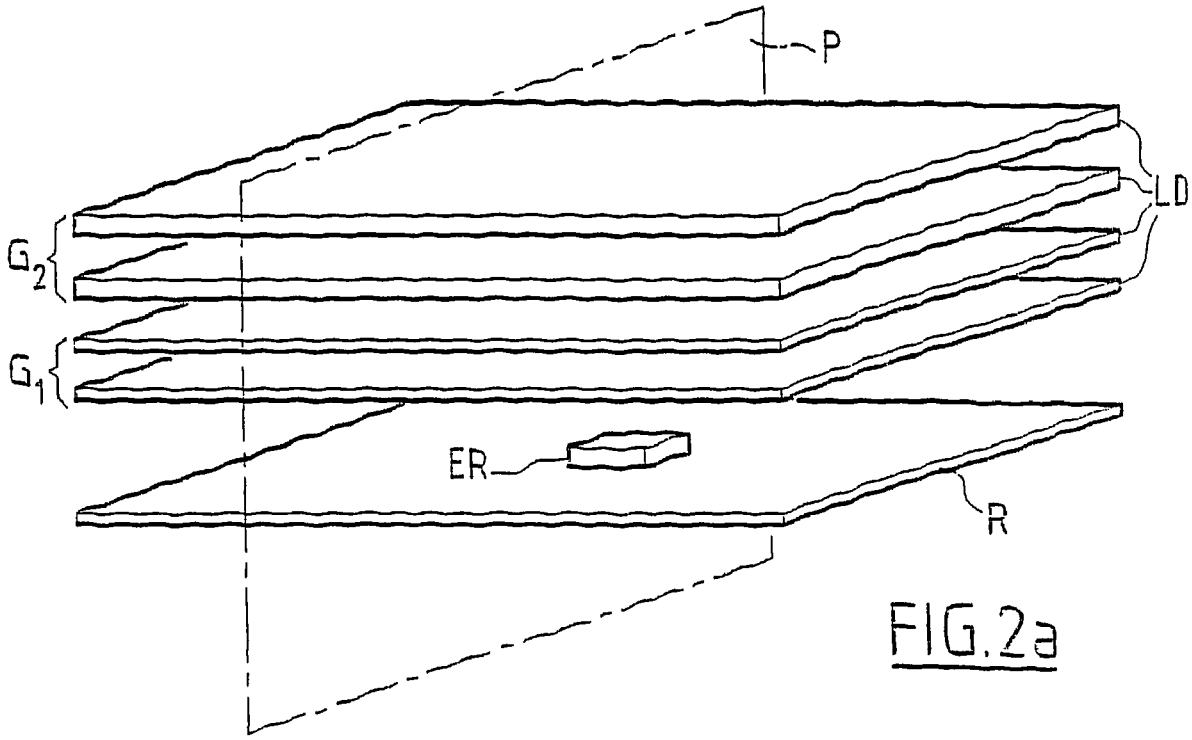
Figure 2B:
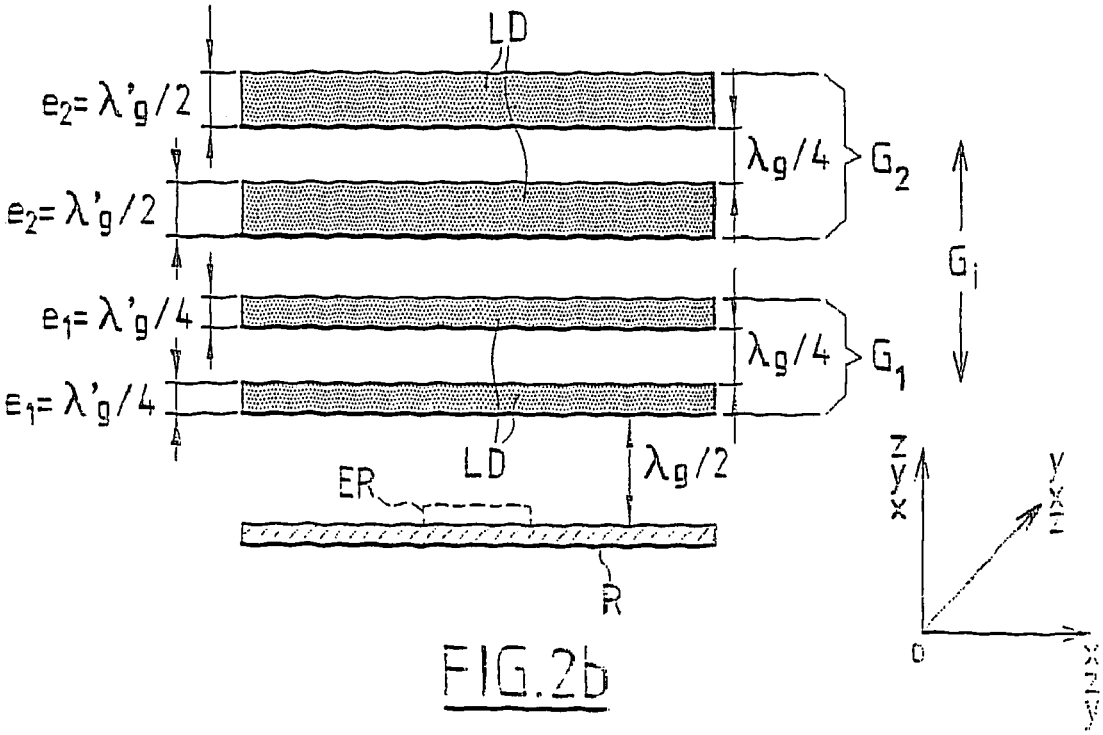

The structure and the method of operation of the broadband or multiband antenna of the present invention will be better understood on reading the description and observing the following drawings in which, in addition to FIGS. 1*a* and 1*b* relating to the prior art:

FIG. 2*a* is a perspective view, by way of illustration, of a broadband or multiband antenna in accordance with the present invention;

FIG. 2*b* is a section view on section plane P of the broadband or multiband antenna of the invention shown in FIG. 2*a;*

Figure 3A:
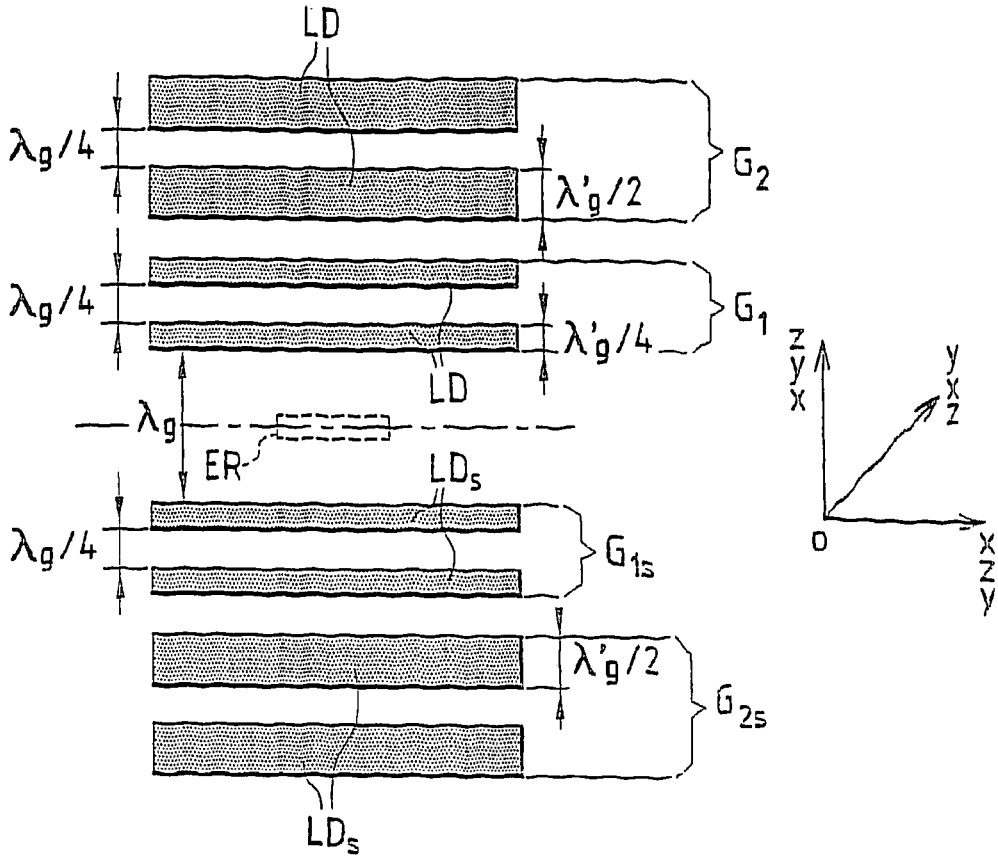

FIG. 3*a* is a section view, by way of illustration, on the same section plane P as is shown in FIG. 2*a* and showing an antenna that is equivalent to the antenna shown in FIG. 2*a* or 2*b;*

Figure 3B:
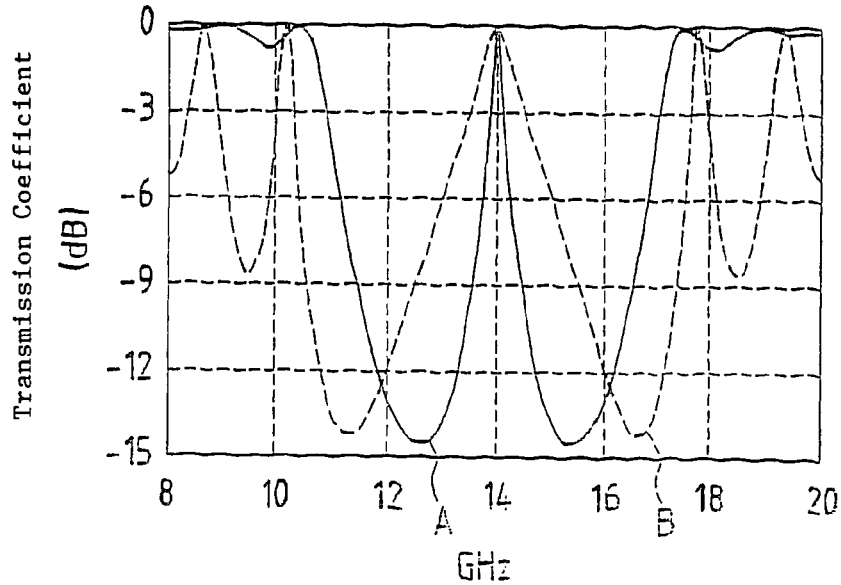
Figure 4:
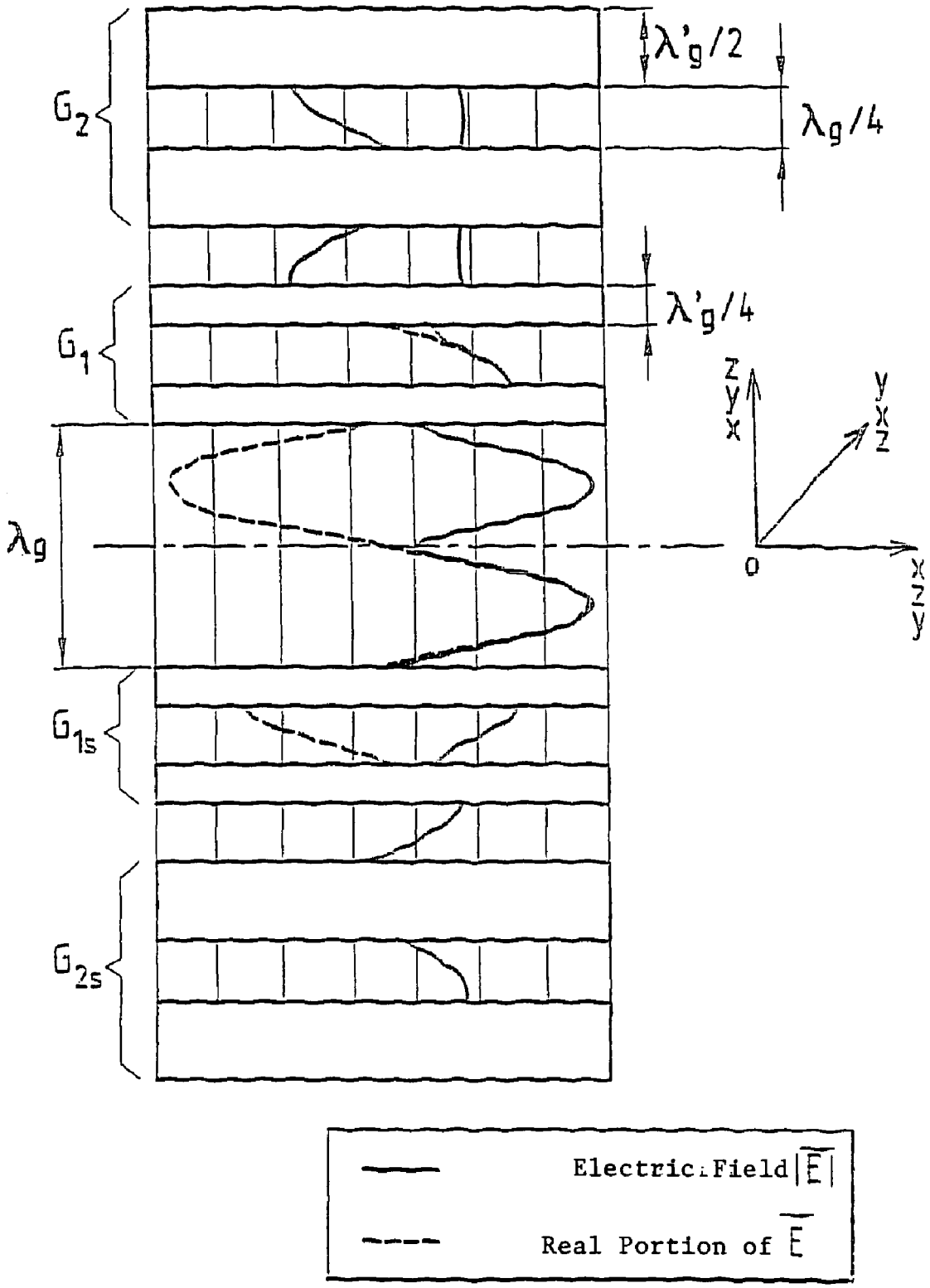
Figure 5:
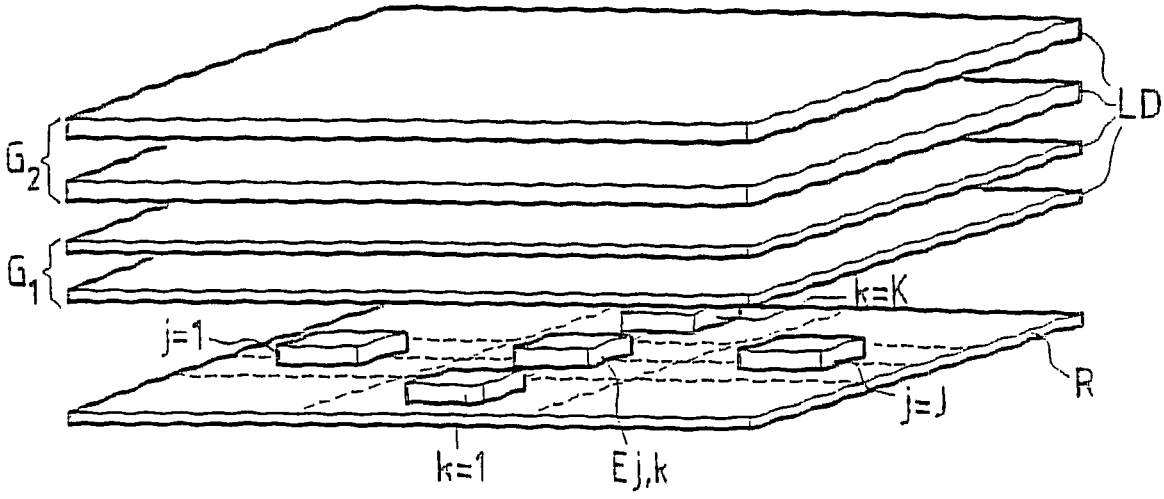

FIG. 3*b* is a chart comparing transmission coefficients as a function of frequency for the prior art antenna shown in above-mentioned French patent application No. 2 801 428, in curve A, and of an antenna constituting the subject matter of the present invention as shown in FIG. 2*a*, 2*b*, or 3*a*, in curve B;

FIG. 4 is a chart illustrating the waveforms generated in the leaky resonant cavity constituting the broadband or multiband antenna of the present invention in its embodiments shown in FIGS. 2*a*, 2*b*, and 3*a*; and FIG. 5 shows an array of antennas implemented on the basis of an antenna of the present invention.

There follows a more detailed description of a broadband or multiband antenna of the present invention given with reference to FIGS. 2*a* and 2*b*, and the following figures.

With reference to FIG. 2*a*, a broadband antenna of the present invention comprises at least one reflector-constituting plane referenced R, said plane possibly being constituted by a metal plate, for example.

In addition, in the vicinity of the reflector plane R, there is provided at least one transmit/receiver radiating element referenced ER. By way of non-limiting example, the radiating element ER may be constituted by radiating dipole, a radiating slot, or a radiating patch or probe, for example. In the embodiment shown in FIG. 2*a*, only one radiating element ER is shown, however it should be understood that the broadband antenna of the present invention may have a plurality of radiating elements ER (not shown in the drawing).

In addition, and as shown in FIG. 2A, the broadband or multiband antenna of the invention includes an assembly of defective PFB material elements disposed in superposition on the plane constituting the reflector R and the plane of the radiating element(s) ER. The term "assembly of defective PFB material elements" is used to mean a plurality of elements constituted by sheets or structures of dielectric material, for example, referenced LD, said elements forming groups or patterns, being stacked in the direction perpendicular to the plane of the reflector and being separated from one another by some other dielectric material, for example a sheet of air, alumina, etc.

Each sheet of dielectric material LD is substantially plane, and each defective .PFB material element is parallel to the plane constituting the reflector R. In addition, according to a particularly advantageous characteristic of the broadband antenna of the present invention, at least one of the characteristics of magnetic permeability, of dielectric permittivity, and/or of thickness in the direction perpendicular to the plane constituting the reflector R and referenced e, differs substantially from one defective PFB material element to another.

Under such conditions, the unit formed by the reflector-constituting plane R and the assembly of defective PFB material elements forms a leaky resonant cavity under conditions that are explained below in the description.

In particular, with reference to FIG. 2*a* and FIG. 2*b*, each sheet of dielectric material LD may present a value of dielectric permittivity, of magnetic permeability, or of thickness e that differs from one defective PFB material element to another, under conditions that are explained below in the description.

FIG. 2*b* is a section view on section plane P in FIG. 2*a* through the broadband antenna of the invention shown in said figure.

Under such conditions, $\lambda'_g$ designates the wavelength of the guided radio signal when the propagation medium is constituted by the material, such as a dielectric material, of each of the sheets LD, and $\lambda_g$ designates the wavelength of the radio signal guided by the gaps between the sheets LD and the defective PFB material elements, i.e. in a non-limiting embodiment by the sheets of air or alumina between the sheets LD shown in FIG. 2*a* and in FIG. 2*b*.

Under such conditions, the notation $\lambda_g$ also designates the wavelength of the guided radio signal propagating between the reflector-forming plane R and the first sheet of dielectric material LD placed facing said reflector plane.

In particular, in FIG. 2*b* there is shown an orthonormal frame of reference for identifying the set of elements constituting the broadband antenna of the present invention.

Under such conditions, and by definition, the reflector plane R is at position 0 in the direction Oz, with the sheets LD being superposed in succession in the above-mentioned direction, and the section plane P is parallel to the plane Ox, Oz. The direction Oy is orthogonal to the above-mentioned plane Ox, Oz.

A particular and non-limiting embodiment of the broadband antenna of the present invention is described below with reference to FIG. 2*b* in a particularly simple and simplified case where the assembly of defective PFB material elements and the sheets of material LD are constituted by sheets of the same dielectric material, by way of example, such that under these conditions they present characteristics of dielectric permittivity and of magnetic permeability that are substantially identical from one sheet of dielectric material to another and from one defective PFB material element to another.

Under such conditions, and with reference to FIG. 2*b*, each sheet of dielectric material LD advantageously presents thickness constituting a non-decreasing function in discrete values of the distance between the sheet of dielectric material in question and the reflector-constituting plane R.

As shown in FIG. 2*b*, each sheet of dielectric material forming the assembly is spaced apart from an adjacent dielectric sheet by a common distance equal to $\lambda_g/4$ where $\lambda_g$ designates the guided wavelength associated with the material separating each of the sheets of dielectric material LD. In the embodiment of FIG. 2*a*, by way of example, $\lambda_g$ designates the guided wavelength associated with the air or the alumina between the sheets of dielectric material LD.

In the same manner, and as shown in detail in FIG. 2*b*, the first sheet of dielectric material LD facing the reflector-constituting plane R and adjacent to said plane is placed at a distance therefrom which is equal to $\lambda_g/2$, where $\lambda_g$ designates in the same manner the guided wavelength associated with the material between the first sheet of dielectric material LD and the reflector-constituting plane R. In the same manner as above, $\lambda_g$ thus designates the guided wavelength of the radio signal when the signal is propagating in the air or the alumina in the non-limiting embodiment that corresponds to FIG. 2*a* or 2*b*.

In addition, as can be seen in detail on observing FIG. 2*b*, in order to constitute the above-mentioned leaky resonant cavity, a plurality of successive sheets of dielectric material LD present the same thickness, this thickness being substantially equal to a fraction of the guided wavelength associated with the dielectric material so as to constitute a group of successive sheets of dielectric material. The resonant cavity can thus be seen to be constituted by a plurality of successive groups of sheets of dielectric material, each group being constituted by a defective PFB material element, the various groups being mutually coupled by their defective zones to constitute the resulting leaky resonant cavity.

Thus, in FIG. 2*b*, specifically, $\lambda'_g$ designates the wavelength of the guided radio signal propagating in each sheet of dielectric material LD.

In addition, as can be seen in FIG. 2*b* in particular, two successive groups of sheets of dielectric material given respective references $G_1$ and $G_2$ and superposed in the direction perpendicular to the plane constituting the reflector R, i.e. in the direction Oz, are constituted by sheets of dielectric material of thickness that increases as a function of the superposition rank of each of the above-mentioned groups.

Thus, in FIG. 2*b* and also FIG. 2*a*, each group $G_1$ and $G_2$ of sheets is shown by-way of non-limiting example as being constituted by two parallel sheets of the same thickness respectively $e_1$ and $e_2$.

For the group $G_1$ of sheets of dielectric material, the group is constituted by sheets of the same thickness $e_1=\lambda'_g/4$, whereas for the group $G_2$ of sheets of dielectric material, each sheet constituted in the group $G_2$ is constituted-by a sheet of the same dielectric material of thickness $e_2=\lambda'_g/2$.

Finally, in a preferred embodiment, the thickness $e_i$ of the sheets of dielectric material LD constituting each group $G_i$ of sheets of dielectric material is in a geometric progression of ratio q in the direction in which successive groups $G_i$ are superposed.

In the non-limiting embodiment of FIG. 2*b*, the number of superposed groups is equal to 2 so as to avoid overcrowding the drawing, and the ratio of the geometric progression is likewise taken to be equal to 2. These values are not limiting.

In addition, and in non-limiting manner, the assembly of defective PFB material elements can be formed by a periodic repetitive structure having characteristics of magnetic permeability, of dielectric permittivity, and of thickness for the sheets of material varying in one, two, or three directions, a perpendicular direction, and one or two directions parallel to the plane constituting the reflector, as described below in the description.

Thus, it will be understood that the superposition of group $G_i$ constitutes a repetition of patterns of characteristics of magnetic permeability, of dielectric permittivity, and of thickness $e_i$ that differ, and that said repetition can be periodic.

A more detailed description of an antenna of structure differing from that shown in FIGS. 2*a* and 2*b* and satisfying the criteria for a broadband or multiband antenna in accordance with the present invention is described below with reference to FIG. 3*a*, this structure nevertheless presenting an equivalent mode of operation in radio terms.

The structure of the broadband or multiband antenna of the present invention as shown in FIG. 3*a* is implemented starting from the preliminary observation whereby the amplitude of the electric field in the vicinity of the reflector-constituting plane R is substantially zero because of the principle of metallic reflection of electric fields in the vicinity of the surface of a metal reflector.

Consequently, as shown in FIG. 3*a*, the broadband or multiband antenna structure of the present invention is obtained by omitting the reflector-constituting plane R and by replacing it with another assembly of defective PFB material elements that is symmetrical, the sheets of dielectric material constituting the symmetrical other assembly of defective PFB material elements being referenced $LD_s$ in FIG. 3*a* because of the above-mentioned symmetry. The symmetry naturally extends relative to the radiating element ER or relative to the set of transmit/receive radiating elements ER and relative to the midplane occupying the location of the omitted reflector-constituting plane R.

For this reason, and because of the symmetry about the above-mentioned location, the groups of the other assembly of sheets of dielectric material $LD_s$ are referenced $G_{1s}$, or $G_{2s}$, as the case may be, by analogy with FIG. 2*b*.

FIG. 3*b* is a chart of transmission coefficients expressed in dB as a function of frequency for the broadband antenna of the present invention as shown in FIG. 2*a*, 2*b*, or 3*b* (curve B), in comparison with a prior art antenna as described in the above-referenced French patent application (curve A).

By comparing the above-mentioned curves, it can be seen that there is a large increase in passband when the antenna structure of the present invention is implemented.

Thus, by way of non-limiting example, and other things remaining equal, for an attenuation of 6 dB relative to the center frequency at 14 gigahertz (GHz) it can be seen that the passband when the broadband antenna structure of the present invention is implemented is at least twice as large as the corresponding bandwidth at the same frequency and for attenuation of 6 db, when an antenna structure of conventional type is implemented.

Finally, FIG. 4 shows the waveforms obtained when implementing a broadband antenna of the present invention, e.g. as shown in FIG. 3*a*, the above-mentioned waves being represented by the amplitude of the electric $|\vec{E}|$ and also the value of real portion of said field E in various zones between the sheets of dielectric material constituting the above-mentioned structure.

Naturally, it will be understood that because of the condition whereby the amplitude of the electric field is substantially zero at z=0, the waveform corresponding to implementing the broadband or multiband antenna of the present invention as shown in FIG. 2*a* or 2*b* corresponds merely to the upper portion of FIG. 4 in which the z dimension is greater than 0.

It can thus be seen that the broadband or multiband antenna structure of the present invention is symmetrical from a geometrical point of view but is anti-symmetrical from the point of view of electric field distribution about the dimension z=0.

In general, the broadband or multiband antenna structure in accordance with the present invention as described in the present description is not limited to the embodiment described with reference to FIGS. 2*a*, 2*b*, and 3*a*, for example. Whereas these structures present a single direction of pattern repetition, along the direction Oz as shown by way of example in FIG. 2*b* or 3*b*, it is naturally possible to provide for repetition to take place in two directions or even in three directions in the directions Oy and Ox of the frame of reference shown in FIG. 2*b*, 3*a*, or 4, for example.

Finally, the sheets of air between the sheets of dielectric material LD can be replaced by dielectric sheets of some other kind, or where appropriate, they can be replaced by sheets of material presenting patterns that are repetitive likewise in the directions x or y, as well as in the direction z as shown in FIG. 2*a*, 2*b*, 3*a*, or 4.

Similarly, the defective PFB material elements making up the superposed patterns or groups may include sheets or elements made of metal or of magnetic material, for example.

That is why, in the above-mentioned figures, the orthonormal frame of reference is written Oxyz, Ozxy, Oyzx so as to take account of repetitive patterns being made in one, in two, or three directions.

Concerning the implementation of repetitive patterns in one, in two, or in three directions or in a combination of structure presenting unidirectional, bidirectional, or three-directional periodicity relative to the reflector plane, reference can usefully be made to above-mentioned French patent application No. 2 801 428, and in particular to FIGS. 3, 4, and 5 respectively thereof. The introduction of a defect for each of the above-mentioned corresponding structures then consists in omitting from the central zone respectively a sheet, a row, or two rows.

In addition, in order to make a multiband antenna of the present invention, the assembly of defective PFB material elements is configured in such a manner as to present a repetitive structure of groups $G_i$ in which the characteristics of magnetic permeability, of magnetic permittivity, and/or of thickness are substantially discontinuous. Introducing such a discontinuity makes it possible, by mutual coupling between the defect zones of the defective PFB material elements, to generate a plurality of disjoint passbands.

Finally, the antenna structure of the present invention makes it possible to implement an array of antennas. As shown in FIG. 5, the resulting antenna array comprises an antenna of the invention as described above in which a plurality of transmit/receive elements $ER_{j,k}$ are distributed periodically in the vicinity of the reflector plane R. The radiating elements $ER_{j,k}$ may be identical. The dimensioning of the array and the number J,K of radiating elements in the two distribution directions thereof are selected as a function of the application or the use of the array. Such arrays find applications in point-to-point and point-to-multipoint telecommunications systems.

A novel broadband or multiband antenna structure is described above that possesses properties that are particularly advantageous in terms of passband while conserving the radiating and compactness properties of the prior art antenna structure, as mentioned above.

In particular, the broadband or multiband antenna structure of the present invention forms a leaky cavity whose operating frequency is determined mainly by the superposition dimensioning of the arrangement of defective PFB material elements. The results obtained have revealed doubling of the passband compared with the above-described prior art device.

The broadband or multiband antenna structure of the present invention makes it possible to escape from one of the limits on using PFB materials for making radiating devices.

What is claimed is:

1. A broadband or multiband antenna comprising a reflector-constituting plane and, in the vicinity of said reflector-constituting plane, at least one transmit/receive radiating element, said antenna further comprising, disposed substantially in superposition on said reflector-constituting plane and said transmit/receive radiating element, an assembly of defective PFB (Photonic Forbidden Band) material elements, each substantially plane defective PFB material element being parallel to said reflector-constituting plane, and at least one of the characteristics of magnetic permeability, of dielectric permittivity, and/or thickness in the direction perpendicular to said reflector-constituting plane being substantially different from one defective PFB material element to another, the assembly formed by said reflector-constituting plane and said assembly of defective PFB material elements forming a leaky resonant cavity.

2. An antenna according to claim 1, wherein said assembly is made up of defective PFB material elements, each element having a structure that is periodic in terms of its characteristics of magnetic permeability, of dielectric permittivity, and of thickness in a direction perpendicular to said reflector-constituting plane.

3. An antenna according to claim 2, said antenna comprising an assembly of defective PFB material elements arranged in a combination of structures presenting unidirectional, bidirectional, or three-directional periodicity relative to said reflector plane.

4. An antenna according to claim 1, wherein said assembly is made up of defective PFB material elements, each element having a structure that is periodic by its characteristics of magnetic permeability, of dielectric permittivity, and of thickness in at least two directions, one direction that is perpendicular and one direction that is parallel to said reflector-constituting plane.

5. An antenna according to claim 4, wherein said defective PFB material elements include metal portions.

6. An antenna according to claim 1 wherein said assembly is made up of defective PFB material elements, each element being of a structure that is periodic in its characteristics of magnetic permeability, of dielectric permittivity, and of thickness in three directions, one direction being perpendicular and two other directions being parallel to said reflector-constituting plane.

7. An antenna according to claim 1, wherein each defective PFB material element is constituted by sheets of the same material having dielectric permittivity and magnetic permeability characteristics that are substantially identical, and each sheet of the same material presents a thickness that is a non-decreasing function in discrete values of the distance of the plate from said reflector-constituting plane.

8. An antenna according to claim 7, wherein each same material sheet forming said defective PFB material element is spaced apart from an adjacent sheet in a direction perpendicular to said reflector plane by a common distance substantially equal to $\lambda_g/4$ where $\lambda_g$ designates the guided wavelength associated with the material separating the same-material sheets.

9. An antenna according to claim 7, wherein a first sheet forming a defective PFB material element adjacent to said reflector-constituting plane is placed at a distance from said plane that is substantially equal to $\lambda_g/2$ where $\lambda_g$ designates the guided wavelength associated with the material separating said first sheet from said reflector-forming plane.

10. An antenna according to claim 1, wherein a plurality of successive same-material sheets present, in a direction perpendicular to said reflector-constituting plane, the same thickness substantially equal to a fraction of the guided wavelength associated with said material so as to constitute a group of successive same-material sheets forming a defective PFB material element, two successive groups of dielectric material sheets superposed in the direction perpendicular to said reflector-constituting plane being constituted by dielectric material sheets of thickness that increases as a function of the superposition ranks of said groups.

11. An antenna according to claim 10, wherein the thickness of the same-material sheets constituting each group of same-material sheets is in a geometric progression of ratio q in the superposition direction of said groups.

12. An antenna according to claim 1, wherein said reflector-constituting plane is omitted and replaced by another assembly of defective PFB material elements symmetrical to said assembly of defective PFB material elements about said at least one transmit/receive radiating element and a medium plane occupying the location of said omitted reflector-constituting plane.

13. An antenna according to claim 1, wherein said assembly of defective PFB material elements presents a repeating structure of groups in which the characteristics of magnetic permeability, dielectric permittivity, and/or thickness are substantially discontinuous so as to generate a plurality of disjoint passbands by mutual coupling of the defect zones of the defective PFB material elements.

14. An array of antennas, comprising a broadband or multiband antenna said antenna comprising a reflector-constituting plane and, in the vicinity of said reflector-constituting plane, at least one transmit/receive radiating element, said antenna further comprising, disposed substantially in superposition on said reflector-constituting plane and said transmit/receive element, an assembly of defective PFB material elements, each substantially plane defective PFB material element being parallel to said reflector-constituting plane, and at least one of the characteristics of magnetic permeability of dielectric permittivity, and/or thickness in the direction perpendicular to said reflector-constituting plane being substantially different from one defective PFB material element to another, the assembly formed by said reflector-constituting plane and said assembly of defective PFB material elements forming a leaky resonant cavity, said antenna comprising a plurality of transmit/receive radiating elements distributed periodically in the vicinity of said reflector-constituting plane.

15. An array of antenna according to claim 14, wherein said assembly is made up of defective PFB material elements, each element having a structure that is periodic in terms of its characteristics of magnetic permeability, of dielectric permittivity, and of thickness in a direction perpendicular to said reflector-constituting plane.

16. An array of antenna according to claim 15, said antenna comprising an assembly of defective PFB material elements arranged in a combination of structures presenting unidirectional, bidirectional, or three-directional periodicity relative to said reflector plane.

17. An array of antenna according to claim 14, wherein said assembly is made up of defective PFB material elements, each element having a structure that is periodic by its characteristics of magnetic permeability, of dielectric permittivity, and of thickness in at least two directions, one direction that is perpendicular and one direction that is parallel to said reflector-constituting plane.

18. An array antenna according to claim 17, wherein said defective PFB material elements include metal portions.

19. An array of antenna according to claim 14, wherein said assembly is made up of defective PFB material elements, each element being of a structure that is periodic in its characteristics of magnetic permeability, of dielectric permittivity, and of thickness in three directions, one direction being perpendicular and two other directions being parallel to said reflector-constituting plane.

20. An array of antenna according to claim 14, wherein each defective PFB material element is constituted by sheets of the same material having dielectric permittivity and magnetic permeability characteristics that are substantially identical, and each sheet of the same material presents a thickness that is a non-decreasing function in discrete values of the distance of the plate from said reflector-constituting plane.

21. An array of antenna according to claim 20, wherein each same material sheet forming said defective PFB material element is spaced apart from an adjacent sheet in a direction perpendicular to said reflector plane by a common distance substantially equal to $\lambda_g/4$ where $\lambda_g$ designates the guided wavelength associated with the material separating the same-material sheets.

22. An array of antenna according to claim 20, wherein a first sheet forming a defective PFB material element adjacent to said reflector-constituting plane is placed at a distance from said plane that is substantially equal to $\lambda_g/2$, where $\lambda_g$ designates the guided wavelength associated with the material separating said first sheet from said reflector-forming plane.

23. An array of antenna according to claim 14, wherein a plurality of successive same-material sheets present, in a direction perpendicular to said reflector-constituting plane, the same thickness substantially equal to a fraction of the guided wavelength associated with said material so as to constitute a group of successive same-material sheets forming a defective PFB material element, two successive groups of dielectric material sheets superposed in the direction perpendicular to said reflector-constituting plane being constituted by dielectric material sheets of thickness that increases as a function of the superposition ranks of said groups.

24. An array of antenna according to claim 23, wherein the thickness of the same-material sheets constituting each group of same-material sheets is in a geometric progression of ratio q in the superposition direction of said groups.

25. An array of antenna according to claim 14, wherein said reflector-constituting plane is omitted and replaced by another assembly of defective PFB material elements symmetrical to said assembly of defective PFB material elements about said at least one transmit/receive radiating element and a medium plane occupying the location of said omitted reflector-constituting plane.

26. An array of antenna according to claim 14, wherein said assembly of defective PFB material elements presents a repeating structure of groups in which the characteristics of magnetic permeability, dielectric permittivity, and/or thickness are substantially discontinuous so as to generate a plurality of disjoint passbands by mutual coupling of the defect zones of the defective PFB material elements.

* * * * *